United States Patent [19]

Baturay et al.

[11] 4,157,921

[45] Jun. 12, 1979

[54] OVEN CLEANING METHOD AND COMPOSITION

[75] Inventors: Susan E. Baturay, Andover; Daniel S. Dzury, Westfield; William J. Lueschen, Somerville, all of N.J.

[73] Assignee: American Home Products Corporation, New York, N.Y.

[21] Appl. No.: 877,584

[22] Filed: Feb. 13, 1978

[51] Int. Cl.[2] ..... B08B 9/00; C11D 7/06

[52] U.S. Cl. ..... 134/4; 134/22 R; 134/40; 252/159; 252/DIG. 2

[58] Field of Search ..... 134/4, 19, 22 R, 40; 252/153, 156, 158, 159, 160, DIG. 2

[56] References Cited

U.S. PATENT DOCUMENTS

| | | | |
|---|---|---|---|
| 3,296,147 | 1/1967 | Gatza | 252/153 |
| 3,658,711 | 4/1972 | Mukai et al. | 252/156 X |
| 3,708,429 | 1/1973 | Hall | 252/159 X |
| 3,829,387 | 8/1974 | Wise et al. | 252/156 |
| 3,881,948 | 5/1975 | Schoenholz et al. | 134/40 X |

*Primary Examiner*—Marc L. Caroff

*Attorney, Agent, or Firm*—Arthur E. Wilfond

[57] ABSTRACT

A thixotropic oven cleaning composition, suitable for use in a pump spray, comprising water, 1 to 7% of an alkali selected from sodium hydroxide, potassium hydroxide and lithium hydroxide, a first thickener, a surfactant, a humectant, an organic solvent and a second thickener comprising a thixotropic emulsion of a copolymer of acrylic acid and ethylene, upon shaking, liquefies so that it can be pump sprayed onto soiled oven surfaces. The composition resolidifies upon contacting the oven surfaces and is removed therefrom after reacting with the soil.

8 Claims, No Drawings

OVEN CLEANING METHOD AND COMPOSITION

This application relates to new and novel compositions for use in cleaning ovens and similar surfaces. More particularly, the instant invention concerns a thixotropic oven cleaning composition suitable for use in a pump spray. This composition, which is primarily water, contains therein 1 to 7% of an alkali selected from the group consisting of sodium hydroxide, potassium hydroxide, and lithium hydroxide, a first thickener, a surfactant, a humectant, an organic solvent and a second thickener comprising a thixotropic emulsion of a copolymer of acrylic acid and ethylene. The invention also includes a method of removing oven soils from oven surfaces, which method comprises applying to a soiled oven surface an effective amount of the above composition to an oven at a temperature from ambient to about 200° F. for time sufficient to effect a reaction between the soil on the oven surface and the oven cleaner. Thereafter, the reaction product is removed from the oven surface.

Among the most distasteful of necessary household tasks, is that of cleaning an oven. Because of the deposit of grease, both fresh and baked-on and hard baked-on food spills, the job of cleaning the oven becomes all but impossible. It is necessary, however, to regularly clean an oven in order to prevent the build up of deposits, which prevent even heat distribution and mar the appearance of the oven. In recent times, several types of products have appeared on the market to aid in cleaning dirty ovens.

One such product, such as described in U.S. Pat. No. 3,196,046 comes as a container holding a mixture of calcium oxide and an ammonium salt. This container is placed in an enclosed oven. Water is added to the mixture to afford steam and ammonia gas, which condense upon the inner surface of the oven. Thereafter, the condensate is removed from the surfaces. This technique has several disadvantages, namely, the ammonia gas produced readily leaks from the oven's ventholes, and the moist ammonia gas can corrode copper. Essential parts of oven thermostats are often made of copper with the resultant possibility that the thermostat may be damaged. Another widely used type of oven cleaner is the spread-on sodium hydroxide or potassium hydroxide formulations. These formulations are messy to apply and must be handled carefully in order not to injure the user. Aerosol sprays are also available. Although the aerosol spray type oven cleaners do not spatter as much, they present their own drawbacks. There are two types of aerosol oven cleaners available. One type product uses a fluorocarbon as the propellant gas. While another type aerosol product use hydrocarbons such as butanes as the propellant gas. Although both products do an effective job of oven cleaning there are drawbacks associated with both propellant systems. For example, the fluorocarbon propellant is ecologically and medically unsound. Fluorocarbons have been suspected of injuring the ozone layer in the atmosphere as well as presenting a number of known or suspected health hazards to the user. The use of hydrocarbons is energy inefficient as the hydrocarbons can be put to a higher utility. It is thus advantageous to provide an oven cleaner composition suitable for use in a pump spray. Such a composition would overcome the drawbacks of ammonia gas generated by some products, the spattering of the brush-on products and the ecological and energy drawbacks of the spray products.

It is advantageous to provide an oven cleaner composition, suitable for use in a pump spray, providing good cleaning capacity, having an opacity sufficient to indicate where it has been sprayed, clinging to the oven surface and providing an emulsion stability such that, although it is stable, presents the cleaning agent to the soiled surface. The present invention provides such an oven cleaner. The oven cleaner of the present invention provides a surface release of active ingredients rapidly enough to effect the cleaning even at ambient temperatures while clinging to the oven wall. Elevated temperatures, however, will accelerate the release of the cleaning ingredients making it possible to clean an oven in a shorter period of time. The oven cleaner composition of the present invention comprises water, 1 to 7%, and preferably 1 to 4%, of an alkali selected from the group consisting of sodium hydroxide, potassium hydroxide and lithium hydroxide, 0.2 to 5%, and preferably 0.2 to 2%, of a first thickener, 0.01 to 1% of a surfactant, 1 to 15% and preferably 1 to 5% of a humectant, 1 to 20% and preferably 1 to 10% of an organic solvent and 0.5 to 10% and preferably 1 to 6% of a second thickener comprising a thixotropic emulsion of a copolymer of acrylic acid and ethylene.

The component ingredients each selected to perform a particular function. Therefore, ingredients which react adversely with each other or injure their respective effectiveness are not selected. Of course, it is possible in certain instances to choose substances which possess more than one property. The compositions comprise mainly water, which acts as a carrier for the other ingredients. The alkali present in this invention is useful in aiding in the removal of the accumulated grime from the ovens. The alkali saponfies the fats to produce soaps and thus remove the oven grime. Although sodium hydroxide is preferred, potassium hydroxide or lithium hydroxide are also suitable. The potassium hydroxide is not as effective as the sodium hydroxide since a given weight of potassium hydroxide does not present as much hydroxyl ions as does the same weight of sodium hydroxide. Lithium hydroxide is more effective than sodium hydroxide, nevertheless, there is a solubility difference between the two. Lithium hydroxide, although more effective than sodium hydroxide, is also more costly and for this reason is not preferred.

Thickening agents present in the composition, as a first thickener, provide body for the composition to assist in allowing it to remain in contact with the oven surface without running. Exemplary of useful first thickening agents are colloidal magnesium aluminum silicate, such as available under the trademark Veegum T from Vanderbilt Co., alginates, ethylene oxide polymers, carboxymethyl cellulose, carboxyethyl cellulose, bentonite, and starches. Of the above, the colloidal magnesium aluminum silicate is preferred. Humectants are present in the composition to aid in slowing the evaporation of the water present in the composition. Some humectants also provide a solvent effect in removing grease. Exemplary of useful humectants are the glycols such as glycerol, propylene glycol, and polyethylene gylcol, and the ethanol amines, such as triethanolamine. Organic solvents are present in the composition to aid in the removal by solubilization of grease from the oven surface. Exemplary of the organic solvents are those which aid in grease removal and are not adversely affected by the other ingredients and do not present a fire hazard. These include ethylene glycol monophenyl ether, methoxy polyethylene glycol, tripropylene glycol methyl ether, diethylene glycol monophenyl ether and phenylglycol ethers. A surfactant such as a nonionic surfactant is present to maintain emulsion stability and provide additional cleaning capacity. Exemplary surfactants are tridecyloxy polyethyleneoxy ethanol and alkylphenoxy polyethoxy ethanol. Also present is a second thickener comprising a thixotropic emulsion of a copolymer of acrylic acid and ethylene emulsified with a tall-oil morpholine soap, such as is available from Chemical Corporation of America, as a 25% solid emulsion under the name Poly Emulsion 540A25, which is a fine particle size ionic emulsion of Allied Chemical Corporation's AC-540 Polyethylene. The copolymer of acrylic acid and ethylene may be prepared as taught in U.S. Pat. No. 3,658,741. Additional water may be introduced with other ingredients such as the thickening agent, the wax emulsion and the caustic soda, etc. If desired, a small amount of a perfume, which does not unfavorably react with any of the other ingredients may be substituted for part of the water.

The AC wax emulsion serves as a thixotropic agent whereby, upon shaking, the contents in the bottle liquidify so that they are sprayable through a pump spray and resolidify or set up upon impinging on the oven surfaces. It also provides a signal capacity by its opacity quality to show where the oven cleaner has been applied. The oven cleaner when first applied is a milky white and when reacted a dirty tan. The AC wax emulsion also aids in presenting the oven cleaner to and increasing the clinging capacity of the oven cleaner to the oven surface wall.

The compositions disclosed herein are useful in cleaning ovens when applied to cold (ambient room temperature) or hot (200° F. to 300° F.) soiled ovens and allowed to remain on the soiled surface until the grime is softened, followed by wiping away the composition, preferably with a damp cloth or sponge. For instance, the composition can be used for a fast daytime cleaning procedure by pump spraying the composition onto an oven preheated (200° F.) and maintained at that temperature during the entire cleaning procedure. The composition is allowed to remain on the heated oven surfaces for about 10 to 30 minutes depending upon the degree of soiling followed by removal with a damp cloth or sponge. For an overnight cleaning procedure, the oven cleaner of the instant composition can be spread on the oven walls and permitted to stand 8 hours or overnight. Finally, one may simply wipe clean the now readily removable soil with a wet cloth or sponge.

EXAMPLES

In the table following, Group I—Formulations are formulations numbered consecutively 1 to 8. These formulations are expressed in percent by weight and upon testing, using recognized methods, provided pump spray oven cleaners of good to excellent cleaning capacity.

TABLE I

GROUP I FORMULATIONS

AMOUNTS EXPRESSED AS PER CENT BY WEIGHT

| Formulation No. | 1 | 2 | 3 | 4 | 5 | 6 | 7 | 8 |
|---|---|---|---|---|---|---|---|---|
| Water | 57.93 | 53.06 | 52.22 | 43.85 | 62.68 | 45.75 | 57.45 | 52.35 |
| Veegum T (3% slurry) | 20.65 | 6.67 | 16.11 | 30.70 | 18.0 | 20.65 | 20.65 | 20.65 |
| Surfactant | 0.02 | 0.10 | 0.25 | 0.22 | 0.24<br>0.60+ | 0.2 | 0.02 | 0.02 |
| Phenylglycol ether | 9.91 | 2.0 | 5.75 | — | — | — | — | 9.91 |
| Triethanolamine | 4.95 | 6.67 | — | 5.09 | 5.10 | 4.95 | 4.95 | 4.95 |
| acrylic acid-ethylene copolymer | 2.94 | — | — | — | 0.89 | 5.88 | — | 3.92 |
| NaOH 50% | 3.60 | 10.10 | 10.70 | 12.66 | 4.49 | 12.66 | 4.08 | 8.10 |
| Na Oleate | — | 0.40 | — | 0.18 | — | — | — | — |
| Bentonite (3% slurry) | — | 21.00 | — | — | — | — | — | — |
| Ethylene glycol monophenyl ether | — | — | 5.12 | — | — | — | — | — |
| Diethylene glycol monophenyl ether | — | — | 5.12 | — | 4.0 | 9.91 | — | — |
| Methoxy polyethylene glycol | — | — | 0.75 | — | 4.0 | — | — | — |
| Polyethylene Emulsion | — | — | 3.98 | — | — | — | — | — |
| Acrylic emulsion-wax component | — | — | — | 0.88 | — | — | 2.94 | — |
| Hexylene glycol | — | — | — | 2.00 | — | — | — | — |
| Tripropylene glycol Methyl ether | — | — | — | 4.42 | — | — | 9.91 | — |
| Total | 100.00 | 100.00 | 100.00 | 100.00 | 100.00 | 100.00 | 100.00 | 100.00 |

+Fluorocarbon Surfactant
*25% solids

Formulations 1 and 8 respectively show preferred formulations containing 1.8 and 4.05% sodium hydroxide. In formulations 2, 3, and 4 the acrylic acid-ethylene copolymer emulsion was replaced. In Example 2, bentonite was used together with a soap such as sodium oleate. In Example 3, polyethylene emulsion, one of the components of the AC wax emulsion 540, was used together with increased organic solvents such as ethyleneglycol monophenyl ether and diethylene glycol monophenyl ether and increased humectant such as methoxy polyethylene glycol. In Example 4, the acrylic emulsion together with hexylene glycol (wax component) and tripropylene glycol methyl ether (an humectant) were substituted for the acrylic acid-ethylene copolymer wax emulsion and the phenylglycol ether. In Example 7, tripropylene glycol methyl ether is used as the organic solvent instead of phenylglycol ether and the acrylic emulsion is used instead of the acrylic acid-ethylene polymer emulsion. In Examples 5 and 6, the phenylglycol ether is replaced with a mixture of diethylene glycol monophenyl ether and methoxy polyethylene ether and diethylene glycol monophenyl ether, respectively. Example 5 also has an additional amount of nonionic surfactant. In this case, a fluorocarbon surfactant. None of the examples wherein the acrylic wax emulsion has been substituted does nearly as well as the preferred formulations, although all do provide some cleaning capacity, opacity clinging and emulsion stability. Formulations 6 and 7, which contain the acrylic acid-ethylene copolymer wax emulsion, are alternatives to the preferred formulations. Furthermore, although the above formulations utilize sodium hydroxide any of the formulations could have used potassium hydroxide or lithium hydroxide instead. Still further, if desired, a small amount of perfume could be substituted for some of the water. In the above examples, those compositions which use a thixotropic emulsion of a copolymer acrylic acid and ethylene are superior to those which have an emulsion of either acrylic acid or an emulsion of ethylene. It is also preferred that the copolymer be emulsified with a tall-oil morpholine soap.

The above examples were given merely by way of illustration and are not to be construed as limitations of the present invention. Many variations of the invention are possible without departing from the scope conspired thereof. All percentages herein are by weight.

We claim:

1. A thixotropic oven cleaning composition, suitable for use in a pump spray, comprising water, 1 to 7% of an alkali selected from the group consisting of sodium hydroxide, potassium hydroxide and lithium hydroxide, 0.2 to 5% of a first thickener, 0.01 to 1% of a surfactant, 1–15% of a humectant, 1–20% of an organic solvent and 0.5 to 10% of a second thickener comprising a thixotropic emulsion of a copolymer of acrylic acid and ethylene.

2. The oven cleaning composition of claim 1, wherein said alkali is present in the amount of about 1 to 4%.

3. The oven cleaning composition of claim 2, wherein said alkali is sodium hydroxide.

4. The oven cleaning composition of claim 3, wherein said thixotropic emulsion is emulsified with a tall-oil morpholine soap.

5. The oven cleaner composition of claim 4, wherein 0.2 to 2% of the first thickener, 0.01 to 1% of the surfactant, 1 to 5% of the humectant, 1 to 10% of organic solvent, and 1 to 6% of the thixotropic emulsion are present.

6. The method of removing oven soil from oven surfaces comprising applying to the soiled oven surface an effective amount of the composition of claim 1 to an oven at a temperature from ambient to an oven about 200° F. for a time sufficient to effect reaction between the soil and the oven cleaner and removing the reaction product from the oven surface.

7. The method of claim 6, wherein the alkali is sodium hydroxide and is present in the amount of 1 to 4%.

8. The method of claim 6, wherein the thixotropic emulsion is emulsified with a tall-oil morpholine soap.

* * * * *